US007891157B2

(12) United States Patent
Elsperger

(10) Patent No.: US 7,891,157 B2
(45) Date of Patent: Feb. 22, 2011

(54) MACHINE FOR SHRINK-FITTING OF SHRINK WRAP FILM ONTO PACKAGES

(75) Inventor: Stefan Elsperger, Schwabering (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 11/959,913

(22) Filed: Dec. 19, 2007

(65) Prior Publication Data

US 2008/0148691 A1 Jun. 26, 2008

(30) Foreign Application Priority Data

Dec. 20, 2006 (DE) ..... 10 2006 060 109

(51) Int. Cl.
*B65B 53/02* (2006.01)

(52) U.S. Cl. ..... 53/442; 53/557

(58) Field of Classification Search ..... 53/441, 53/442, 557, 556

See application file for complete search history.

(56) References Cited

U.S. PATENT DOCUMENTS

| | | | | |
|---|---|---|---|---|
| 2,790,286 | A * | 4/1957 | Snyder | 53/478 |
| 4,104,845 | A * | 8/1978 | Hoffmann | 53/410 |
| 4,228,345 | A | 10/1980 | Stricker et al. | |
| 6,925,777 | B2 * | 8/2005 | Fresnel | 53/399 |

FOREIGN PATENT DOCUMENTS

| | | |
|---|---|---|
| CH | 692420 | 6/2002 |
| DE | 2323224 | 11/1974 |
| EP | 0 134 689 A2 | 3/1985 |
| EP | 1288129 | 3/2003 |
| FR | 2 332 179 | 6/1977 |
| FR | 2 858 297 | 2/2005 |
| GB | 2 142 900 A | 1/1985 |
| WO | WO-02/36436 | 5/2002 |

OTHER PUBLICATIONS

European Search Report; Date of Completion of Search—Mar. 13, 2008; based on European Patent Application No. EP 07021763.3-2308.

Chinese Office Action for Application No. 200710160333.0 dated Jul. 31, 2009.

* cited by examiner

*Primary Examiner*—Hemant M Desai
(74) *Attorney, Agent, or Firm*—Marshall, Gerstein & Borun LLP

(57) ABSTRACT

A machine and method for shrink-fitting shrink film onto packaged goods, in particular for packaging packing units, having a conveyor for transporting the packaged goods. In order to reduce the energy consumption and simultaneously to improve the shrinking result, the machine has hood type shrink devices which are moved along at least a part of the path with the packaged goods moved on the conveyor.

19 Claims, 5 Drawing Sheets

MACHINE FOR SHRINK-FITTING OF SHRINK WRAP FILM ONTO PACKAGES

CROSS-REFERENCE TO RELATED APPLICATION

The present application claims the benefit of priority of German Patent Application No. 10 2006 060 109.2 filed Dec. 20, 2006. The entire text of the priority application is incorporated herein by reference in its entirety.

FIELD OF THE DISCLOSURE

The disclosure relates to a machine and a method for shrink-fitting shrink film onto packaged goods.

BACKGROUND

Machines of this type are known, for example, from EP 1 288 129. This document describes a shrink-fit tunnel in which packaged goods, such as packing units with bottles, cans or the like are conveyed on a conveyor belt through a tunnel. In the tunnel, hot air blowers ensure that the shrink film surrounding the packaged goods is heated and shrunk onto the packing unit. However, these known shrink-fit tunnels have the disadvantage that, due to the conveying movement of the packing unit in the tunnel and the design of the tunnel for packaged goods of different sizes, said tunnels are relatively long and relatively high. Consequently, the tunnel volume is relatively large. Therefore, since the entire tunnel has to be heated and has relatively large entry and exit openings, a large part of the energy produced by the hot air blowers is lost.

SUMMARY OF THE DISCLOSURE

It is therefore an object of the present disclosure to provide a machine and a corresponding method for shrink-fitting shrink film onto packaged goods, wherein the shrinking process can be carried out with a smaller loss of energy.

By means of the provision of hood type shrink devices which cover the packaged goods on the conveyor, and in particular cover them individually, and are then moved along a part of the path with the packaged goods in the conveying direction, the volume to be heated is lessened and therefore the heat energy loss is reduced. This effect can be still further improved if, depending on the packaged goods, suitably adapted hood type shrink devices are used.

Advantageously, the hood type shrink device comprises a hood which is closed at the top. By this means it is ensured, over the whole of the partial path, that heat loss upwardly is prevented while the hood type shrink device covers the packaged goods.

Preferably, the hood type shrink device can cover the packaged goods completely. By means of the complete covering, lateral energy losses are prevented and, at the same time, even heating of the shrink film is enabled, leading to controlled shrinkage of the film. In the case, particularly, of printed shrink films, results that are visually good can also be achieved.

According to a preferred embodiment, the hood type shrink device may have nozzles in the side wall of the hood for blowing in hot air. Usually for the packaging of packing units, for example a packing unit with bottles, the packing unit is wrapped with the shrink film such that initially two sides have no film on them. The sides that are not covered then have openings in the film, here referred to simply as "film openings". If hot air is blown intensively into this area, the laterally extending film pulls together very strongly and also partially covers these sides of the packing unit. The nozzles in the side walls therefore enable targeted blowing of hot air into the film opening and, in particular, no slip stream is produced, as occurs in the known shrink-fit tunnels, and which leads to an imprecise shrinking result.

Advantageously, the machine may have a transport belt which is designed such that it moves with the speed of the conveyor and to which the hood type shrink device can be coupled. Through the provision of the transport belt, it is ensured by simple means that the hood type shrink device is moved in synchronism with the conveyor belt. Through the additional possibility of coupling the hood type shrink device, the possibility is also created that hood type shrink devices are only made use of if the packaged goods are transported on the conveyor.

Preferably, the machine may have a cam, particularly a slotted guide, in order to predefine the movement path of hood type shrink device, including lowering in the direction of the packaged goods, movement parallel to the packaged goods and lifting the hood type shrink device to remove it from the packaged goods. Thanks to the cam, the movement of the hood type shrink device in the plane perpendicular to the conveying plane can be realized such that jerk-free and collision-free movement of the hood type shrink device is enabled, simultaneously leading to the even heating of the shrink film.

An advantageous embodiment of the machine may comprise additional heating means, particularly a hot air blower, under the conveyor. Normally, the region of overlap of the shrink film with which the packaged goods, in particular the packing unit, has been wrapped is situated under the packaged goods. By this means, the thicker seam is made invisible to a user. Provision of the hot air blower under the conveyor has the result that the welding of the seam site and the shrinking can be carried out in one passage.

Advantageously, a flap can additionally be provided over the additional heating means which is designed such that it is opened by the lowered hood type shrink device, in particular by means of cams. This ensures that heat is fed in from underneath only if packaged goods are actually situated over the additional heating means. This further improves the energy balance of the machine.

The machine can preferably have a plurality of hood type shrink devices arranged in a row, so that successively arranged packaged goods can be covered. By this means, a high turnover through the machine can be ensured without sacrificing the energy advantage of moving hood type shrink devices.

According to a further embodiment, the machine may have a second transport belt whose speed is, in particular, greater than that of the first transport belt and which serves to transport the at least one hood type shrink device back again after shrink-fitting the shrink film onto the packaged goods. By decoupling the accompanying movement in the conveying direction from the return transport, with the machine running, it is made possible to mount additional hood type shrink devices on the second transport belt, in order possibly thereby to increase the throughput, or in order to prepare the machine for a new product. Furthermore, the more rapid return transport of the hood type shrink devices on the second transport belt brings about a high throughput with only a few hood type shrink devices.

The disclosure also relates to a method for shrink-fitting shrink film onto packaged goods according to the features of claim 12. As with the device according to claim 1, through this method, the energy losses, such as those which occur in known shrink-fit tunnels due to the size of the tunnel, can be reduced.

Preferably, the hood type shrink device can cover the packaged goods completely. This enables the most even possible heating of the shrink film.

Advantageously, the hood type shrink device can be closed at the top. This avoids energy losses through rising heat.

According to a preferred embodiment, the hood type shrink device can be coupled to a transport belt over a part of the path, wherein the transport belt moves at the same speed as the conveyor. This enables a hood type shrink device to be deployed only when packaged goods are transported on the conveyor. The provision of the transport belt simultaneously enables synchronous accompanying movement using simple means.

Advantageously, the hood type shrink device can be moved towards the article by means of a cam, in particular a slotted control guide and can cover the packaged goods and then, following the covering, can be moved parallel to the packaged goods and, following the shrink-fitting, moved away from the packaged goods again. As a result of the cam, the movement of the hood type shrink device can be carried out in the plane perpendicular to the conveying plane such that a jerk-free and collision-free movement of the hood type shrink device is enabled, simultaneously leading to even heating of the shrink film.

Preferably, heat can also be fed to the packaged goods from underneath. Usually, a film is laid round the packaged goods, in particular a packing unit, which overlaps under the packing unit. This has the advantage that the joint seam is not visible to the user. Provision of the heating means under the packaged goods means that the shrinking and the welding of the two film ends to one another can be carried out simultaneously.

Preferably, in the covering condition, the hood type shrink device can open a flap under the conveyor, in particular via cams, so that the heat can be supplied from underneath. Thus, heat is only supplied from underneath when packaged goods are situated over the flap, and this results in further energy savings.

Preferably, after the shrink-fitting, the hood type shrink device can be returned via a second transport belt to the start of the first transport belt, in particular, faster than with the first transport belt. By decoupling the accompanying movement in the conveying direction from the return transport, it is made possible, with the machine running, to mount additional hood type shrink devices on the second transport belt, in order thereby possibly to increase the throughput or in order to prepare the machine for a new product. In addition, the faster return transport of the hood type shrink devices on the second transport belt achieves a higher throughput with only a few hood type shrink devices.

According to a preferred embodiment, heat can be supplied to the packaged goods, in particular to the film opening, via nozzles in the side wall of the hood. The provision of nozzles in the side wall of the hood is able to ensure the most even possible heating of the film and, additionally, in the event of blowing into the film opening, stronger shrinkage of the film can be ensured in this region so that the film can be made to lie against the packing unit. Thereby that the hood and the packaged goods do not perform any movement relative to one another, no slip stream is created which would deflect the hot air and produce poor shrinkage results in the film opening.

Preferably, a plurality of hood type shrink devices can be deployed one after the other in order to package a plurality of packaged goods following one after the other. This ensures a high throughput.

BRIEF DESCRIPTION OF THE DRAWINGS

The disclosure will now be described in greater detail using an exemplary embodiment, by reference to the drawings, in which.

DETAILED DESCRIPTION

Figure 1:
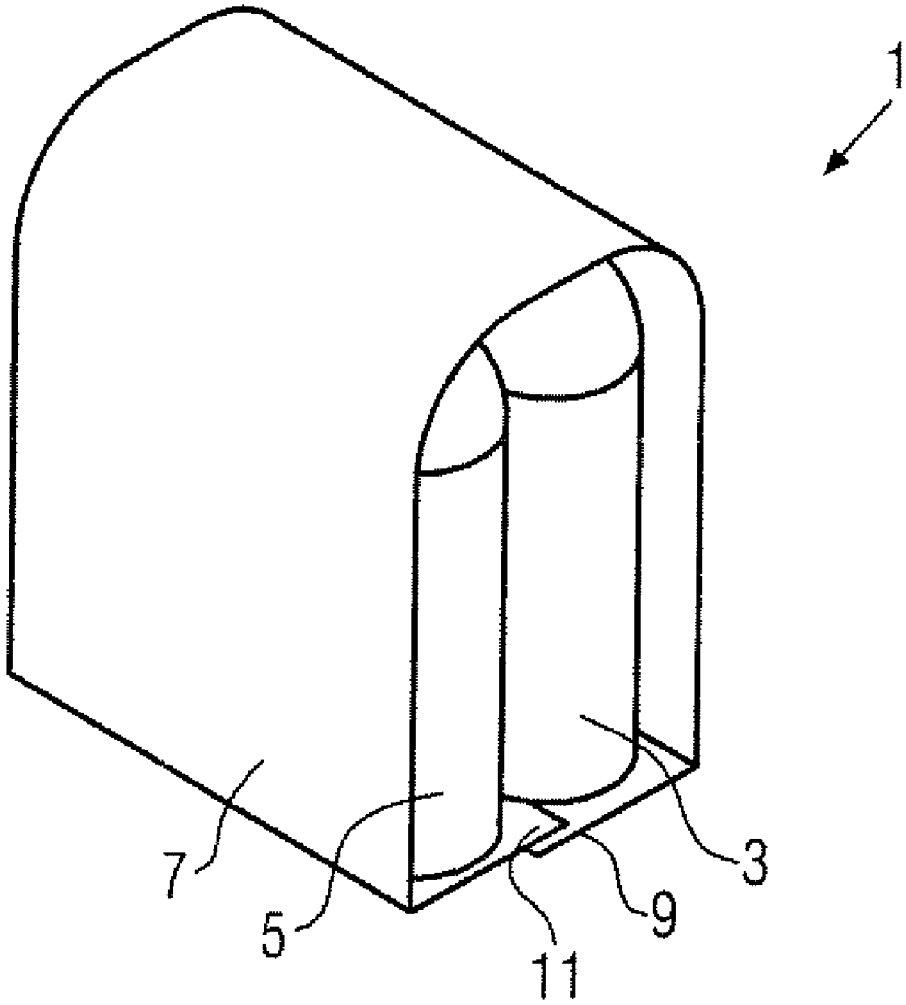
FIG. 1 shows an example of a packing unit with still unheated shrink film.

FIG. 1 shows a packing unit 1 comprising a plurality of bottles 3, 5 which is partly wrapped round with a shrink film 7. The packing unit 1 shown in FIG. 1 is an example of packaged goods that are packaged in a machine for shrink-fitting shrink film according to the disclosure, as explained in relation to the other drawings.

Normally, as shown in FIG. 1, a strip of shrink film of a predetermined length is laid, matched to the packing unit, round the bottles 3, 5 such that the two ends 9 and 11 cross or overlap each other over an area under the bottles 3, 5. The openings produced at the side of the packing unit 1 by the covering with the shrink film 7 are referred to here as "film openings".

Before the shrinking, the shrink film 7 lies loosely and usually does not hold the bottles 3, 5 together. Following the shrinking, the shrink film 7 lies closely against the bottles 3, 5 and, at least partially, closes the film openings. Usually, during the shrinking process, the two ends 9, 11 of the shrink film 7 are also welded to one another.

In the example shown, the packing unit 1 contains bottles. It could equally be cans or any other containers or articles that are packed. There may also be any desired number of containers in the packing unit 1. In addition, the individual containers could also be arranged in a case or box which, together with the vessels, is wrapped round with the shrink film 7.

Rather than laying a shrink film strip round the bottles 3, 5, a previously produced sleeve made of shrink film could equally be laid round the bottles 3, 5. The overlap region can also be at another site. However, it is preferably situated under the bottles, since the seam is then not visible due to the bottles standing thereon.

Figure 2:
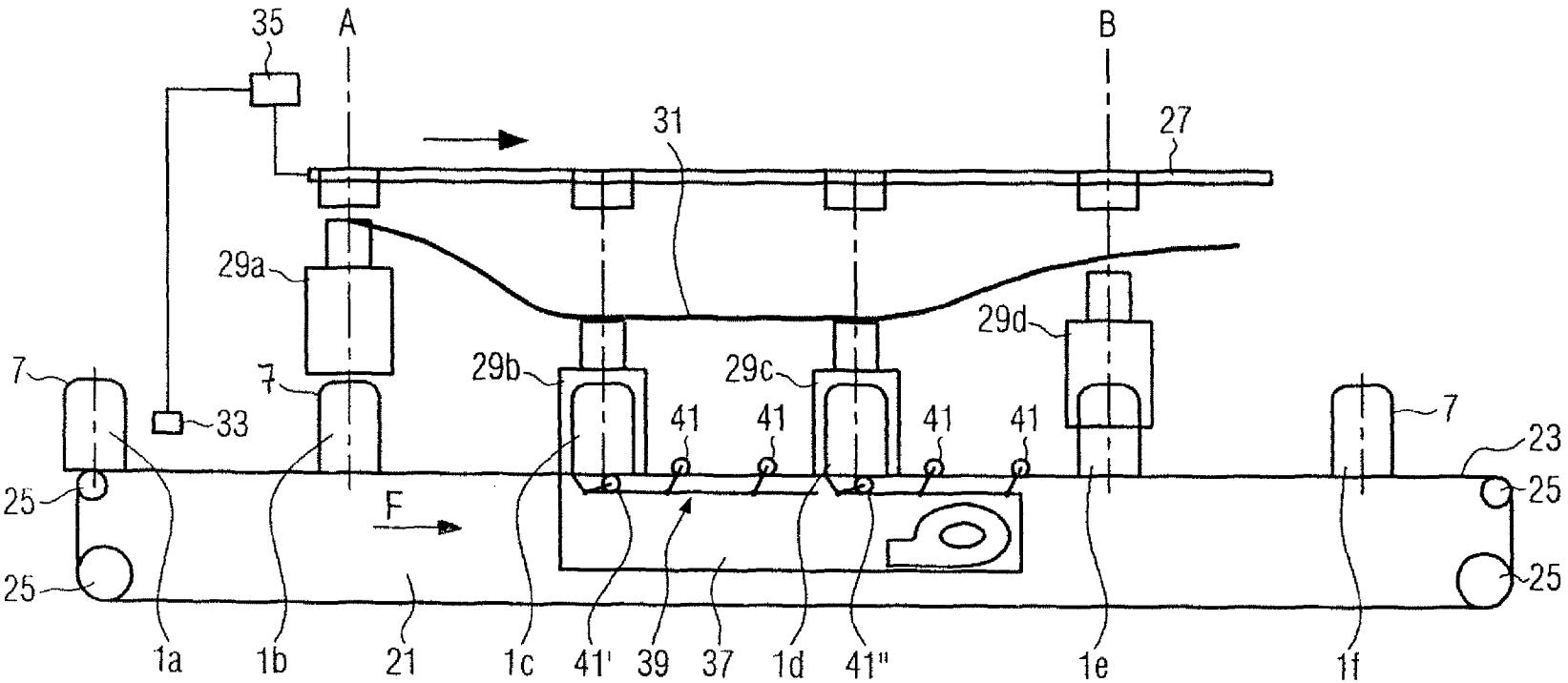
FIG. 2 shows a side view of an embodiment of the machine for shrink-fitting shrink film.

FIG. 2 shows a side view of an embodiment of a machine for shrink-fitting shrink film onto packaged goods and, in particular, for packaging packing units, according to the disclosure. FIG. 2 shows six packing units 1*a* to 1*f*, for example, packing units as shown in FIG. 1. With regard to the features and properties of the packing unit, reference is made to the description relating to FIG. 1.

The packing units 1 wrapped round with shrink film 7 are transported by a conveyor 21 in the direction of the arrow F.

The conveyor 21 represented in the exemplary embodiment comprises a conveyor belt 23 which is deflected at the start and the end over rollers 25. Along a partial stretch of the conveyor—from position A to position B—a transport belt 27 is arranged above the conveyor 21. By contrast with the conveyor 21, in this embodiment the transport belt 27 is not deflected in the plane of the drawing but perpendicularly thereto, as will be made clear below in relation to FIG. 3, although other arrangements are equally possible. Four hood type shrink devices 29*a*, 29*b*, 29*c* and 29*d* are coupled to this transport belt 27. The number of hood type shrink devices 29*a*, 29*b*, 29*c* and 29*d* is purely exemplary here. However, according to the disclosure, the machine for shrink-fitting has at least one hood type shrink device 29. The hood type shrink devices 29*a*, 29*b*, 29*c* and 29*d* shown here all have the same shape, which is also adapted to the shape of the packing unit 1. If different packing units with different shapes are to be conveyed on the conveyor 21, hood type shrink devices of different form can be coupled to the transport belt 27. The transport belt 27 moves with substantially the same speed as the conveyor 21 in the direction of the arrow F and accordingly carries the coupled-on hood type shrink devices 29*a*, 29*b*, 29*c* and 29*d* with it and, consequently synchronously with the conveyor belt 23 in the direction of the arrow. By means of a cam 31 configured, for example, as a slotted guide, the hood type shrink devices 29*a*, 29*b*, 29*c* and 29*d* are moved according to a predetermined path, not only in the conveying direction, but also perpendicularly to the conveying plane. The cam 31 therefore allows lowering of the hood type shrink devices 29*a*, 29*b*, 29*c* and 29*d* during the forward movement, in this case in the region between the hood type shrink devices 29*a* and 29*b*, such that in the lowered region—at the height of the hood type shrink device 29*b*—the hood type shrink device covers the packing unit 1*c*.

As shown here, the hood type shrink device 29*b* covers the packing unit 1*c* completely, but depending on how the shrink film 7 is to be shrink-fitted, it may be sufficient to cover the packing unit only partially. In the region between the hood type shrink devices 29*b* and 29*c*, the hood type shrink devices move, in the covering condition, synchronously with the packing units 1*c* and 1*d* situated under the hoods. In the region between the hood type shrink device 29*c* and the hood type shrink device 29*d*, the hood type shrink devices are lifted again and moved away from the packing units 1*d* and 1*e*.

In order that a hood type shrink device 29*a*, 29*b*, 29*c* and 29*d* can cover a packing unit 1*a* to 1*f* moving forward on the conveyor 21, a detecting means 33, in particular a sensor, for example an optical light barrier, is provided. This sensor 33 detects a passing packing unit, for example packing unit 1*a*, and sends a corresponding signal to the control unit 35. Thereupon, a hood type shrink device 29*a*, 29*b*, 29*c* and 29*d* is coupled to the transport belt 27 at the correct time point.

Furthermore, according to a further variant of the disclosure, the machine for shrink-fitting the shrink film 7 onto packaged goods, in this case a packing unit 1, has a heating means 37, for example a hot air blower, under the conveyor belt 23. This may be arranged in an upwardly open housing case. By means of this heating means 37, heat is fed to the base of the packing unit 1*a* to 1*f*, so that particularly in the overlap region 9, 11 of the shrink film 7 (see FIG. 1), welding of the ends of the film and, furthermore, additional shrinking, can take place. In order to operate in the most energy-saving manner possible, flaps 39 seal off the heating means 37. Only when a hood type shrink device 29*a*, 29*b*, 29*c*, 29*d* is arranged in the lowered condition (as exemplified by the hood type shrink devices 29*b*, 29*c* in FIG. 2) above a flap 39 is said flap opened. This condition is illustrated below the hood type shrink devices 29*b* and 29*c*. For example, this opening is carried out by means of cams 41 which are pressed down or pivoted by the passing hood type shrink device, in this case cam 41' and cam 41". Also conceivable are spring-loaded or weighted flaps which return automatically to a closed position.

Figure 3:
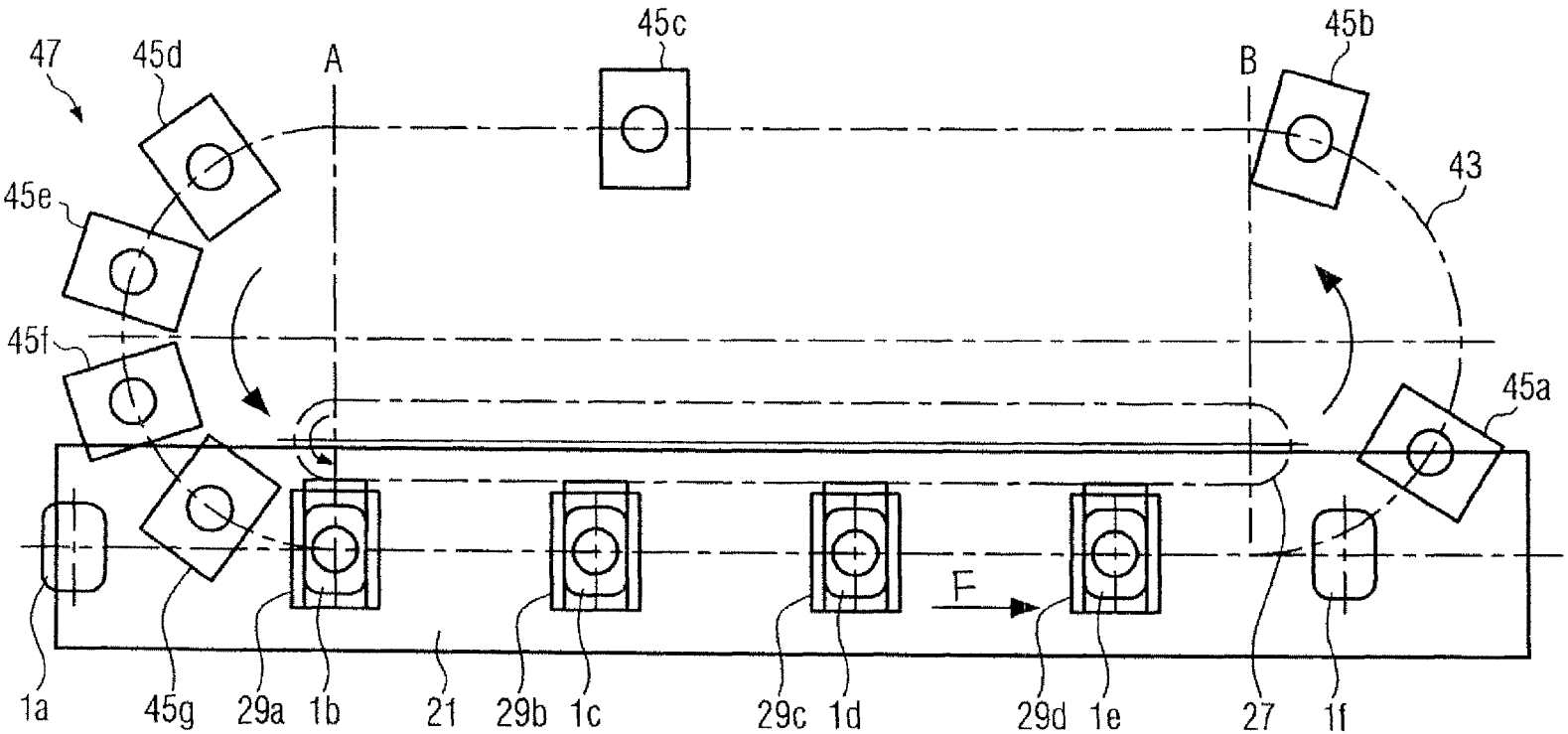
FIG. 3 shows a schematic view from above of this embodiment.

FIG. 3 shows a schematic plan view of the machine already illustrated in FIG. 2 for shrink-fitting shrink film onto packaged goods. The transport belt 21, the packing units 1*a* to 1*f*, and the four hood type shrink devices 29*a*, 29*b*, 29*c* and 29*d* move forward in the direction of the arrow together with the packing units 1*a* to 1*f*, wherein the hood type shrink devices 29*a* to 29*d* are moved forward with the transport belt 27 at the same speed as the conveyor belt 23.

In addition to the elements of the machine for shrink-fitting shrink film onto packaged goods, as described above in relation to FIG. 2 and to the description of which reference was made above, the plan view shows a second transport belt 43 which transports the hood type shrink devices 45*a* to 45*g* which have been uncoupled from the first transport belt 27 back again at the end of the shrinking process. Before the coupling onto the first transport belt 27, hood type shrink devices, here 45*d* to 45*g* can be placed into intermediate storage in a type of station 47.

Hood type shrink devices can be removed along the second transport belt 43, for example, in the event of defects and/or additional hood type shrink devices can be added in order to increase the throughput of the machine, and/or to replace the existing hood type shrink devices with other hood type shrink devices if packing units are to be packed in another form. If as few hood type shrink devices as possible are to be used, according to the disclosure, the transport speed of the second transport belt 43 is greater than that of the first transport belt 27.

Figure 4:
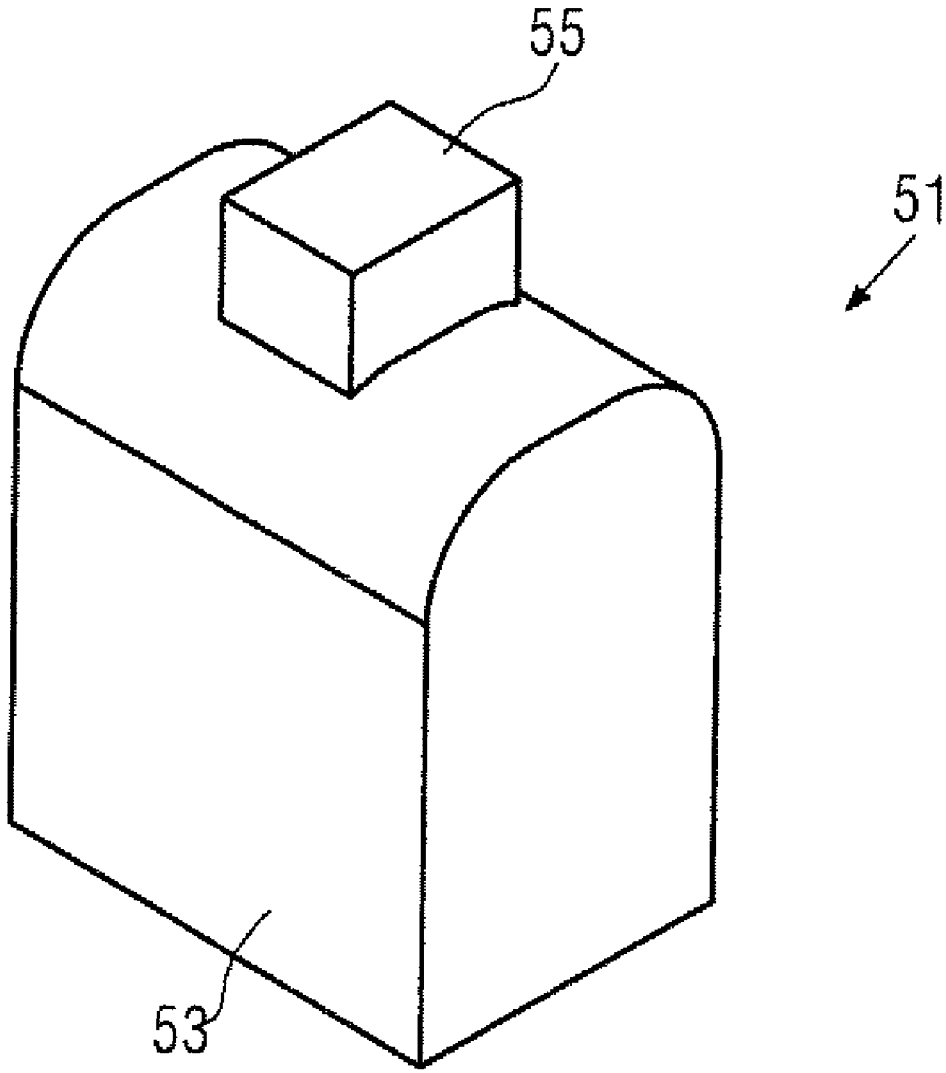
FIG. 4 shows a three-dimensional external view of a hood type shrink device, as used in the machine according to the disclosure.

FIG. 4 shows an embodiment of a hood type shrink device 51 as used in the machine shown in FIGS. 2 and 3—designated hood type shrink devices 29*a* to 29*d* and 45*a* to 45*g*. The form of the hood 53 is chosen such that it corresponds in its interior space as far as possible to the form of the packing unit 1, wherein suitably selected intermediate spaces must be present in order for hot air to circulate. Since the shrinking of the film 7 round the packing unit 1 (see FIG. 1) is carried out with the aid of heat, a hood type shrink device 51 also has a heating means 55, in particular a heater, for example with electrical heating elements and a blower motor. Thereby that each hood type shrink device 51 has its own heat source, the design of the machine for shrink-fitting is simplified.

Figure 5:
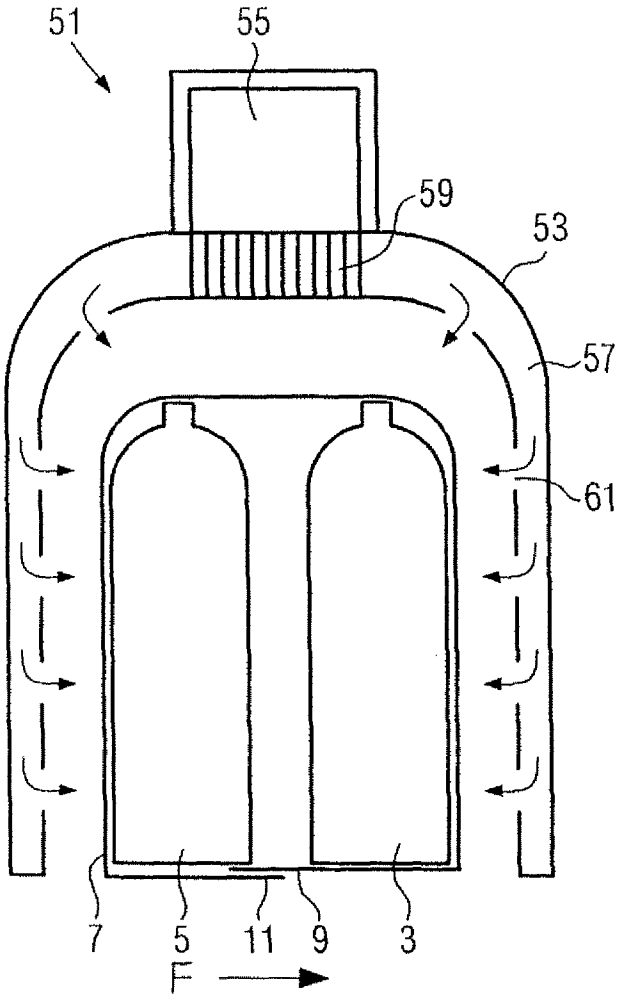
FIG. 5 shows a cross-section through the hood type shrink device of FIG. 4, wherein the sectional plane lies in the movement direction.

FIG. 5 shows a transverse section through the hood type shrink device 51 of FIG. 4, wherein the section is made in the conveying direction F perpendicularly to the conveying plane. Visible in the interior is the packing unit 1 with the bottles 3, 5 and the shrink film 7, the ends 9, 11 of which overlap under the bottles 3, 5. The hood type shrink device 51 covers the packing unit 1 completely.

As is also visible in the sectional view, the hood 53 has a channel 55 along which hot air is fed from the heater 55 with a blower 59, via nozzles 61 onto the side surfaces and the upper surface of the shrink film 7. In a variant with a variable cross-section, the nozzles 61 may be constructed to be controllable and settable.

Figure 6:
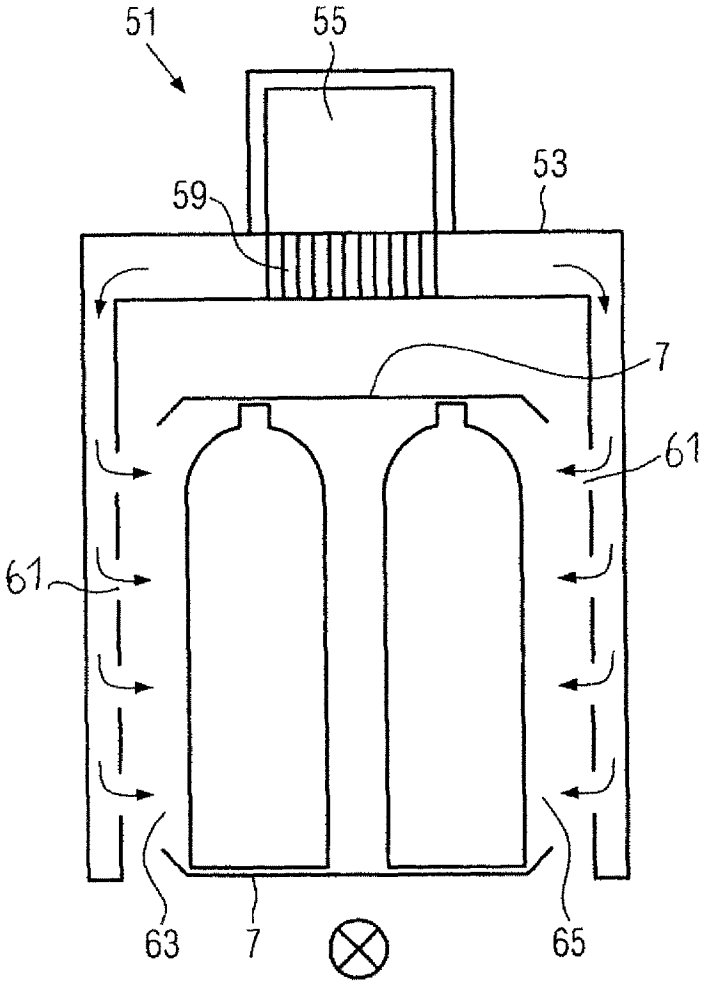
FIG. 6 shows a section through the hood type shrink device of FIG. 4 perpendicularly to the movement direction.

FIG. 6 shows a further cross-sectional view of the hood type shrink device 51, although in a sectional plane perpendicular to the conveying direction and perpendicular to the conveying plane. The design of the hood type shrink devices 51 is substantially the same as previously illustrated and described in relation to FIG. 5. The same reference signs denote similar elements and, with regard to their description, reference is made to the above.

In this view, the film openings 63 and 65 mentioned in relation to FIG. 1 can be seen and hot air is again fed to these from the nozzles 61. This has the effect that the shrink film 7 initially extending laterally at the top and the bottom lies round the bottles 3, 5 and contracts such that the film openings 63 and 65 at least partially close.

In the sectional views of FIGS. 5 and 6, the nozzles 61 are distributed evenly in both directions. However, it is possible to arrange the nozzles 61 differently in the region of the film openings 63, 65, in order further to improve the shrinking results.

With the machine described, the following advantages can be obtained. Due to the fact that, as shown in FIGS. 5 and 6, the volume of the interior of the hood 53 is only insubstantially larger than the volume of the packing unit 1, compared with the known shrink-fit tunnels, the quantity of air to be heated is small. Therefore unnecessary energy losses can be avoided. This is further enhanced thereby that the hood preferably screens the heated space not only upwardly, but also all round, with the result that the heat losses are minimized.

Furthermore, the accompanying movement of the hood type shrink devices with the packing units permits the air to be blown in optimum manner onto the lateral film openings. This results therefrom that the packing unit does not pass by the row of nozzles, as with a shrink-fit tunnel, but remains stationary relative to the nozzles, that is, there is no relative movement in the conveying direction. Therefore no slip stream, which in known shrink-fit tunnels causes the lateral film protrusion to shrink unevenly, is able to occur. Therefore an improved shrinking result is achieved in the region of the film opening.

The method according to the disclosure for shrinking shrink film onto packaged goods and particularly for packaging packing units 1, as shown in FIG. 1, will now be described by reference to the machine according to the disclosure which is described above and to its mode of operation.

Firstly, a packing unit 1 wrapped round at least partially with a shrink film 7 (see FIG. 1) is guided by a conveyor 21 (see FIG. 2) past a sensor 33. The sensor 33 sends a signal to the control unit 35, which thereupon couples a hood type shrink device 29*a* to the transport belt 27 such that the hood type shrink device 29*a* and the packing unit 1*b* are moved synchronously in the conveying direction (see arrow F). The hood type shrink device 29*a* then moves along the cam 31, formed for example, by a slotted control guide and is lowered such that, at the height of the packing unit 1*c*, it covers said packing unit (at the height of the hood type shrink device 29*b*). In this embodiment, complete covering takes place. With the covering, the shrinking process is begun by the provision of hot air, which is blown by means of a blower motor 59 and the heater 55 through nozzles 61 in the side wall of the hood 53 onto the shrink film 7 and into the film opening 63 and/or 65 (see FIGS. 5 and 6).

At the same time, according to one variant, hot air can also be fed in from underneath from the heating means 37. For this purpose, flaps 39 under the conveyor belt 23 open. This may be effected, for example, by moving the hood type shrink devices 29*b*, 29*c* over cams 41, 41'. Through the provision of hot air from underneath, the ends 9, 11 of the shrink film 7 (see FIG. 1) are welded to one another and also shrunk.

Following the shrinking process, at the height of the hood type shrink device 29*d*, the hood type shrink device is removed again from the packing unit 1 and, at the height of the position B is uncoupled from the transport belt 27. A hood type shrink device has thus traveled along a part of the path with the packaged goods, in this case a packing unit 1, in the conveying direction. The packing unit 1*f* with the now shrink-fitted film covering is transported away by the conveyor belt 23.

As shown in FIG. 3, the hood type shrink device which has been uncoupled from the transport belt 27 is transported back again by the second transport belt 43, in particular at a raised speed. Once there, it can if necessary be stored temporarily before being put to use again. Preferably, a plurality of hood type shrink devices are used in order to be able to make the throughput of the machine correspondingly high.

With the method according to the disclosure, the same advantages as mentioned above are achieved as with the machine according to the disclosure.

In deviation from the configuration shown in FIG. 3, the hood type shrink devices can be permanently coupled to their driving conveyor belt or the like, that is, they then run at a particular mutual spacing, synchronously with the speed of the packing units, on a closed path. Furthermore, in place of an oval circulation path, a circular circulation path could also be chosen, wherein the packing unit is synchronously moved, at least in sections, along a circular sector. This can be achieved with a relatively small effort by means of a carousel carrying a plurality of hood type shrink devices on its periphery. Here, too, a rigid coupling of the hood type shrink devices to the carousel is conceivable.

The invention claimed is:

1. Machine for shrink-fitting shrink film onto packaged goods, in particular for packaging packing units, comprising a conveyor for transporting the packaged goods, at least one hood type shrink device with means for heating shrink film, the at least one hood type shrink device at least partially covering the packaged goods transported on the conveyor and moving along with the packaged goods at least along a part of the path in the conveying direction, and an additional heating means under the conveyor belt, and having a transport belt which is so configured as to move at the speed of the conveyor, wherein the at least one hood type shrink device can be coupled to the transport belt, and having a second transport belt for return transport of the at least one hood type shrink device after uncoupling the at least one hood type shrink device from the transport belt.

2. Machine according to claim 1, wherein the hood type shrink device comprises a hood which is closed at the top.

3. Machine according to claim 1, wherein the hood type shrink device covers the packaged goods completely.

4. Machine according to claim 1, wherein each hood type shrink device has a heater and a blower.

5. Machine according to claim 1, wherein the hood type shrink device has nozzles in the side wall of the hood for blowing in hot air.

6. Machine according to claim 1, and having a cam for predetermining the movement path of the hood type shrink device, including lowering it in the direction of the packaged goods, moving it parallel to the packaged goods and lifting it for removal from the packaged goods.

7. Machine according to claim 6, wherein the cam is a slotted guide.

8. Machine according to claim 1, and having at least one flap over the additional heating means, which flap is so configured to be opened by the lowered hood type shrink device.

9. Machine according to claim 8, wherein the flap is opened by cams.

10. Machine according to claim 1, and having a plurality of hood type shrink devices which are arranged in a row so that successive packaged goods can be covered.

11. Machine according to claim 1, and the speed of the second transport belt is faster than that of the first transport belt, for return transport of the at least one hood type shrink device following shrink-fitting of the shrink film onto the packaged goods.

12. Machine according to claim 1, wherein the conveyor is a conveyor belt.

13. Machine according to claim 1, wherein the additional heater means is a hot air blower.

14. Machine for shrink-fitting shrink film onto packaged goods, in particular for packaging packing units, comprising:

a conveyor for transporting the packaged goods;

at least one hood type shrink device with means for heating shrink film, the hood type shrink device at least partially covering the packaged goods transported on the conveyor and moving along with the packaged goods at least along a part of the path in the conveying direction;

a first transport belt arranged above the conveyor, the first transport belt being configured to move at the speed of the conveyor and being adapted to transport the hood type shrink device;

a second transport belt the speed for which is faster than that of the first transport belt, for return transport of the hood type shrink device following shrink-fitting of the shrink film onto the packaged goods, wherein the second transport belt is arranged to transport the hood type shrink device to an intermediate storage station for storing the hood type shrink device before re-coupling the hood type shrink device onto the first transport belt; and an additional heating means under the conveyor.

15. Machine according to claim 14, and having a cam for predetermining the movement path of the hood type shrink device, including lowering it in the direction of the packaged goods, moving it parallel to the packaged goods and lifting it for removal from the packaged goods.

16. Machine according to claim 14, and having at least one flap over the additional heating means, which flap is so configured to be opened by the lowered hood type shrink device.

17. Machine according to claim 14, and having a plurality of hood type shrink devices which are arranged in a row so that successive packaged goods can be covered.

18. Machine according to claim 14, wherein each hood type shrink device has a heater and a blower.

19. Machine according to claim 14, wherein the hood type shrink device comprises a hood which is closed at the top.

* * * * *